US008499420B2

(12) United States Patent
Elia

(10) Patent No.: US 8,499,420 B2
(45) Date of Patent: Aug. 6, 2013

(54) STRAP BUCKLE

(76) Inventor: Gerardo P. Elia, Montreal (CA)

( * ) Notice: Subject to any disclaimer, the term of this patent is extended or adjusted under 35 U.S.C. 154(b) by 666 days.

(21) Appl. No.: 12/767,679

(22) Filed: Apr. 26, 2010

(65) Prior Publication Data

US 2010/0287739 A1 Nov. 18, 2010

(51) Int. Cl.
*A44B 11/04* (2006.01)

(52) U.S. Cl.
USPC ..... 24/200; 24/26

(58) Field of Classification Search
USPC ..... 24/26, 27, 200
See application file for complete search history.

(56) References Cited

U.S. PATENT DOCUMENTS

| | | | | | |
|---|---|---|---|---|---|
| 55,854 | A | * | 6/1866 | Gunning et al. | 24/200 |
| 416,480 | A | * | 12/1889 | Mayer | 24/200 |
| 686,129 | A | | 5/1901 | Ragsdale et at | |
| 733,950 | A | * | 7/1903 | Eddleman | 24/26 |
| 980,701 | A | * | 1/1911 | Swafford | 24/26 |
| 3,112,543 | A | | 12/1963 | Derrickson | |
| 3,349,444 | A | * | 10/1967 | Beach | 24/200 |
| 3,377,666 | A | | 4/1968 | Sherman | |
| 3,623,190 | A | | 11/1971 | Karass | |
| 3,624,868 | A | * | 12/1971 | Somann | 24/200 |
| 3,663,995 | A | | 5/1972 | Somann | |
| 3,924,302 | A | * | 12/1975 | Somann | 24/200 |

* cited by examiner

*Primary Examiner* — Robert J Sandy

(57) ABSTRACT

A strap buckle made from a single piece of bent material, the bent material forming a first generally U-shaped portion; a second generally U-shaped portion; and an elongated intermediary portion between the first and second generally U-shaped portions; the first generally U-shaped portion having a distal leg, a proximal leg shorter than the distal leg, and an intermediate bight between the distal and proximal legs; the second generally U-shaped portion having a distal leg, a proximal leg shorter than the distal leg, and an intermediate bight between the distal and proximal legs, such that the distal legs are located in the same plane, are parallel to one another, and extend perpendicularly to the elongated intermediary portion. The interweaving of these portions provides the buckling functionality as well as the non-slippage feature.

12 Claims, 4 Drawing Sheets

STRAP BUCKLE

This application claims priority based on request GB0908386.6 filed May 15, 2009.

FIELD OF THE INVENTION

The present invention relates generally to buckles used with flexible strapping materials. More particularly, it relates to buckle constructions.

BACKGROUND OF THE INVENTION

There are many types of steel buckles that are used in the construction trade such as those described by M. O. Derickson (U.S. Pat. No. 3,112,543), N. H. Sherman (U.S. Pat. No. 3,377,666) or T. J. Karass (U.S. Pat. No. 4,004,770). These prior art buckles dealt with tension, distribution of forces, shearing, parallelism, and reduced slippage.

SUMMARY OF THE INVENTION

In view of the foregoing disadvantages inherent in the known devices now present in the prior art, the present invention, which will be described subsequently in greater detail, is to provide objects and advantages which are:

To provide for a buckle construction, having all of the features of the prior art and wherein linear and accurate movement of load bearing members, under load is resisted, and most importantly, slippage is eliminated.

To attain these ends, the present invention generally comprises a strap buckle made from a single piece of bent material, the bent material forming a first generally U-shaped portion; a second generally U-shaped portion; and an elongated intermediary portion between the first and second generally U-shaped portions; the first generally U-shaped portion having a distal leg, a proximal leg shorter than the distal leg, and an intermediate bight between the distal and proximal legs; the second generally U-shaped portion having a distal leg, a proximal leg shorter than the distal leg, and an intermediate bight between the distal and proximal legs, such that the distal legs are located in the same plane, are parallel to one another, and extend perpendicularly to the elongated intermediary portion; the proximal leg of the first generally U-shaped portion being located in a plane parallel to and higher than the plane of the distal legs, and the proximal leg of the second generally U-shaped portion being located in a plane parallel to and lower than the plane of the distal legs, wherein an angle is formed in the elongated intermediary portion such that the elongated intermediary portion extends horizontally within the plane of the proximal leg of the second generally U-shaped portion until after passing under the distal leg of the second generally U-shaped portion and then bends upwards and connects with the proximal leg of the first generally U-shaped portion, such that when a strapping member is properly looped around the first and second generally U-shaped portions and tension is applied, frictional forces are created between the adjacent distal and proximal legs, thereby holding the strapping member in position and with the desired tensile load. The interweaving of these portions provides the buckling functionality as well as the non-slippage feature.

In a preferred embodiment, the bent material is formed from metal, has a circular cross-section.

The distance between the distal leg of the second generally U-shaped portion and the proximal leg of the first generally U-shaped portion is not less than ¼ of an inch; and the distance between the distal leg of the first generally U-shaped portion and the proximal leg of the second generally U-shaped portion is not less than 3/16 of an inch.

The angle of the bend in the elongated intermediary portion cannot be less than 10 degrees and the angle of the bend in the elongated intermediary portion cannot be more than 90 degrees.

The buckle is used in combination with a strap and the interweaving of these portions provides the buckling functionality as well as the non-slippage feature.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
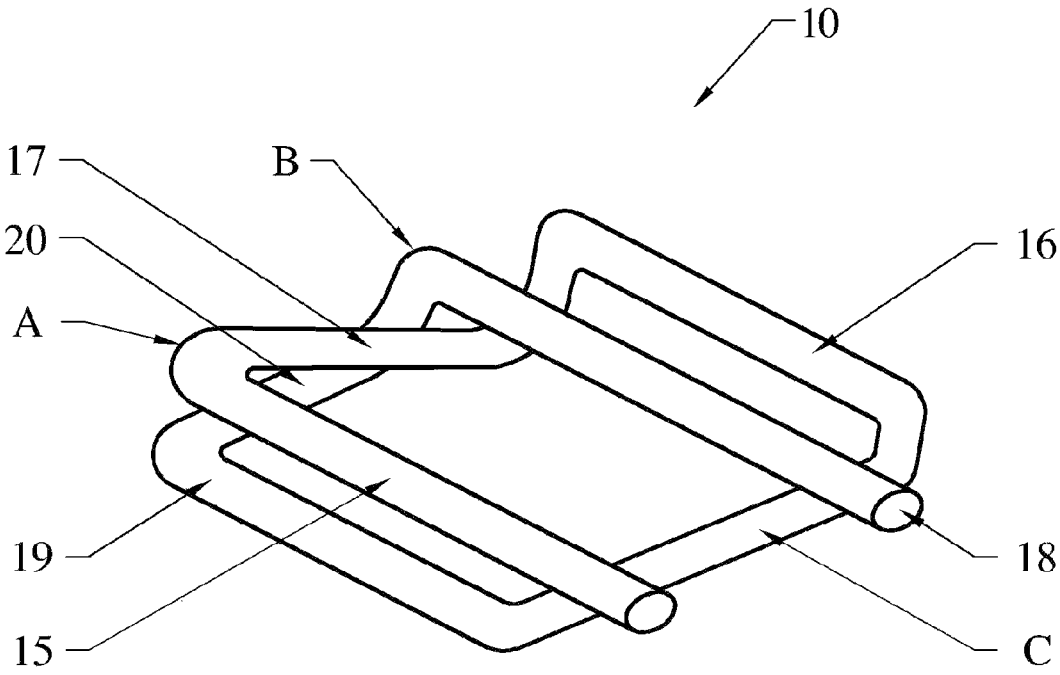
FIG. 1 Is a perspective view of the invention.

A strap buckle 10 is made from a single piece of bent material, preferably metal. The bent material is preferably circular in cross section and is shaped and formed into a first generally U-shaped Portion A; a second generally U-shaped Portion B; and an elongated intermediary Portion C between the first and second generally U-shaped portions.

Portion A includes a distal leg 15, a shorter proximal leg 16 and an intermediate bight 17. In a similar manner, Portion B includes a distal leg 18, a shorter proximal leg 19, and an intermediate bight 20.

Legs 15 and 18 are formed from a free end of the simple piece of bent material as shown in FIG. 1. elongated intermediate member Portion C connects the proximal legs 16 and 19 of Portions A and B. The elongated intermediate member Portion C joins leg 16 to leg 19, while leg 15 and leg 18 are on the primary load bearing members of the buckle 10 and which are set apart from leg 16 and leg 19. All legs 15, 16, 18, and 19 are parallel to each other and extend perpendicularly to the elongated intermediary Portion C.

Figure 2:
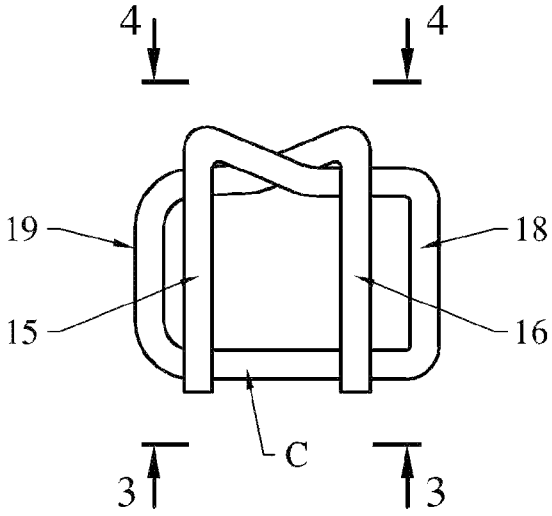
FIG. 2 is a plan view of the invention.

As shown on FIG. 2, the buckle 10 shows a distance between items 16 and 18 to be not less than ¼ of an inch, and items 15 and 19 not less than 3⁄16 of an inch.

Figure 3:
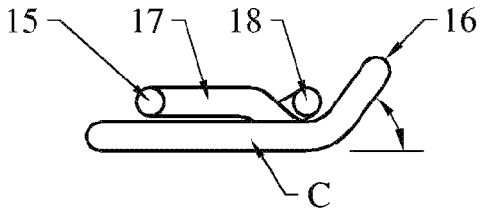
FIG. 3 is a cutaway view along line 3-3.
Figure 5:
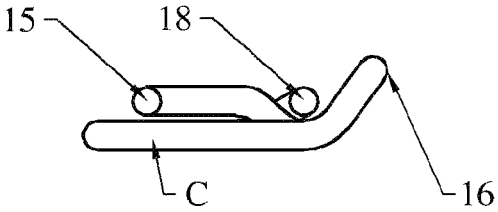
FIG. 5 is an end view, alternate embodiment of the invention
Figure 4:
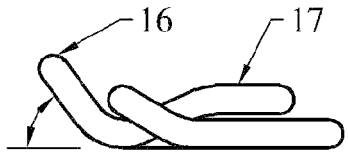
FIG. 4 is a cutaway view along line 4-4.

FIG. 3 shows a side view of FIG. 2 with the most important fact, the angle between C and item 16, the angle cannot be less than 10° and not more than 90°.

This angle is required in order for the strap to be tensioned. If the angle is less than 10° and greater than 90°, it would be impossible to tension the strap.

Figure 6:
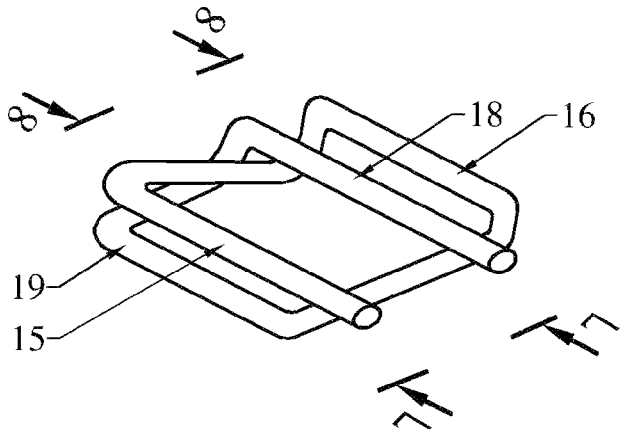
FIG. 6 Is a perspective view of the invention showing cutaways 7 and 8.
Figure 7:
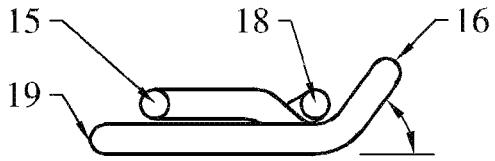
FIG. 7 is a cutaway view along line 7-7.
Figure 8:
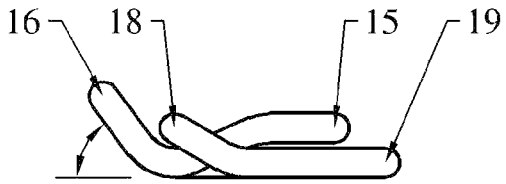
FIG. 8 is a cutaway view along line 8-8.

The U-shape shows the gap between the legs 16 and 18, as best seen in FIG. 6, in order to feed the strap. The bottom part of the leg 16 must be higher than the distal leg 18 in order for the strap to feed without any difficulty. Friction is created between the legs 16 and 18 by having three loops of 180°: one loop on leg 16, two loops on distal leg 18. Similarly between legs 19 and 15. As tension is applied between legs 16 and 18, 19 and 15 the distal legs 18 and 15 close on to 16 and 19 eliminating any type of slippage.

Figure 9:
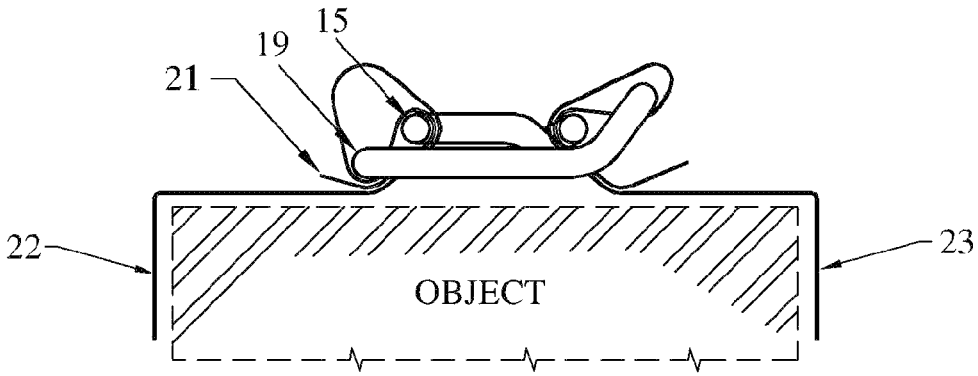
FIG. 9 is a side view of the invention in context of use, but before the tensioning.
Figure 10:
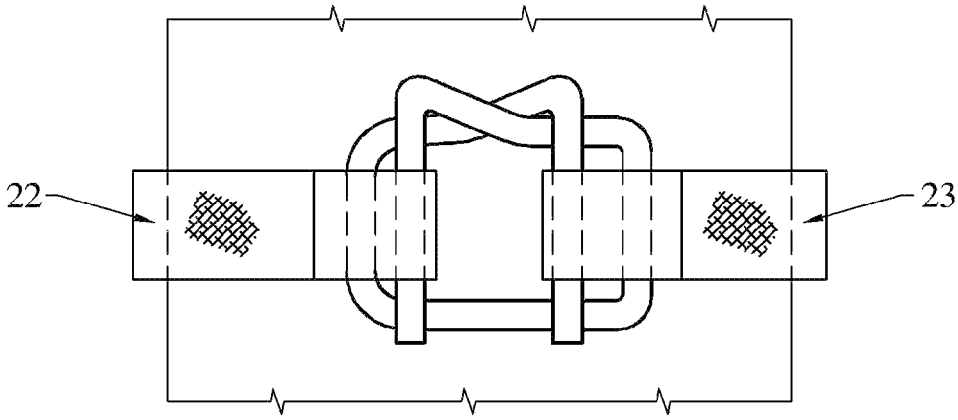
FIG. 10 is a top view of FIG. 9.
Figure 11:
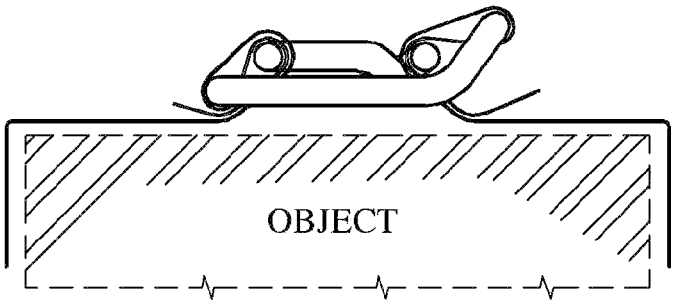
FIG. 11 is a side view of the invention in context of use, after tensioning.

Referring to FIG. 9, on the side of first strap item 22 a free end 21 of the strapping is threaded under leg 19 and leg 15 and then upward then around leg 19 moving upward towards leg 15, around leg 15 but under the strap and out, leaving 3 to 4 inches of strapping from the buckle 10.

Same applies for the second feeding of the second strap item 23. The strap goes around the box under legs 16 and 18, then around leg 16, around leg 18 but under the strap, and pulling the strap through the loops. At this point tension is applied to secure the box or load.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A buckle for strapping members comprising a single piece of bent material, said bent material forming a first generally U-shaped portion; a second generally U-shaped portion; and an elongated intermediary portion between said first and second generally U-shaped portions; said first generally U-shaped portion having a distal leg, a proximal leg shorter than said distal leg, and an intermediate bight between said distal and proximal legs; said second generally U-shaped portion having a distal leg, a proximal leg shorter than said distal leg, and an intermediate bight between said distal and proximal legs, such that said distal legs are located in the same plane, are parallel to one another, and extend perpendicularly to said elongated intermediary portion; said proximal leg of said first generally U-shaped portion being located in a plane parallel to and higher than said plane of said distal legs, and said proximal leg of said second generally U-shaped portion being located in a plane parallel to and lower than said plane of said distal legs, wherein an angle is formed in said elongated intermediary portion such that said elongated intermediary portion extends horizontally within the plane of said proximal leg of said second generally U-shaped portion until after passing under the distal leg of said second generally U-shaped portion and then bends upwards and connects with the proximal leg of said first generally U-shaped portion, such that when a strapping member is properly looped around said first and second generally U-shaped portions and tension is applied, frictional forces are created between the adjacent distal and proximal legs, thereby holding the strapping member in position and with the desired tensile load.

2. The buckle of claim 1, wherein the bent material is formed from metal.

3. The buckle of claim 1, wherein the bent material has a circular cross-section.

4. The buckle of claim 1, wherein the distance between the distal leg of the second generally U-shaped portion and the proximal leg of the first generally U-shaped portion is not less than ¼ of an inch; and the distance between the distal leg of the first generally U-shaped portion and the proximal leg of the second generally U-shaped portion is not less than 3⁄16 of an inch.

5. The buckle of claim 4, wherein the angle of the bend in said elongated intermediary portion cannot be less than 10 degrees.

6. The buckle of claim 4, wherein the angle of the bend in said elongated intermediary portion cannot be more than 90 degrees.

7. A strap and buckle combination comprising a strapping member formed of flat and elongated material; and a buckle member comprising a single piece of bent material, said bent material forming a first generally U-shaped portion; a second generally U-shaped portion; and an elongated intermediary portion between said first and second generally U-shaped portions; said first generally U-shaped portion having a distal leg, a proximal leg shorter than said distal leg, and an intermediate bight between said distal and proximal legs; said second generally U-shaped portion having a distal leg, a proximal leg shorter than said distal leg, and an intermediate bight between said distal and proximal legs, such that said distal legs are located in the same plane, are parallel to one another, and extend perpendicularly to said elongated intermediary portion; said proximal leg of said first generally U-shaped portion being located in a plane parallel to and higher than said plane of said distal legs, and said proximal leg of said second generally U-shaped portion being located in a plane parallel to and lower than said plane of said distal legs, wherein an angle is formed in said elongated intermediary portion such that said elongated intermediary portion extends horizontally within the plane of said proximal leg of said second generally U-shaped portion until after passing under the distal leg of said second generally U-shaped portion and then bends upwards and connects with the proximal leg of said first generally U-shaped portion, such that when said strapping member is properly looped around said first and second generally U-shaped portions and tension is applied, frictional forces are created between the adjacent distal and proximal legs, thereby holding said strapping member in position and with the desired tensile load.

8. The buckle of claim 7, wherein the bent material is formed from metal.

9. The buckle of claim 7, wherein the bent material has a circular cross-section.

10. The buckle of claim 7, wherein the distance between the distal leg of the second generally U-shaped portion and the proximal leg of the first generally U-shaped portion is not less than ¼ of an inch; and the distance between the distal leg of the first generally U-shaped portion and the proximal leg of the second generally U-shaped portion is not less than 3/16 of an inch.

11. The buckle of claim 10, wherein the angle of the bend in said elongated intermediary portion cannot be less than 10 degrees.

12. The buckle of claim 10, wherein the angle of the bend in said elongated intermediary portion cannot be more than 90 degrees.

* * * * *